United States Patent [19]

Rodriquez

[11] Patent Number: 4,817,805

[45] Date of Patent: Apr. 4, 1989

[54] APPARATUS FOR SECURING, DISPLAYING AND DISPENSING OF ENVELOPE PACKAGE GOODS

[75] Inventor: Isidoro L. Rodriquez, Hialeah, Fla.

[73] Assignee: Very Best Foods, Inc., Miami, Fla.

[21] Appl. No.: 60,633

[22] Filed: Jun. 11, 1987

[51] Int. Cl.[4] ..... A47F 5/00

[52] U.S. Cl. ..... 211/71; 206/482; 211/72; 211/113; 248/205.3

[58] Field of Search ..... 211/71, 113, 57.1, 59.1, 211/72; 248/205.3; 206/482, 477

[56] References Cited

U.S. PATENT DOCUMENTS

| | | | |
|---|---|---|---|
| 2,361,141 | 10/1944 | Woolf et al. | 206/482 |
| 2,606,665 | 8/1952 | Caswell | 211/72 |
| 2,647,640 | 8/1953 | Ellis | 211/72 |
| 4,312,449 | 1/1982 | Kinderman | 206/482 X |
| 4,422,552 | 12/1983 | Palmer et al. | 206/482 X |
| 4,667,827 | 5/1987 | Calcevano | 211/72 X |

*Primary Examiner*—Robert W. Gibson, Jr.

*Attorney, Agent, or Firm*—Griffin, Branigan & Butler

[57] ABSTRACT

There is provided an apparatus for securing, displaying and dispensing a plurality of envelope packaged foods. The apparatus has an elongated masking strip with a plurality of spaced apart apertures therein, and an elongated securing strip attached to the back side of the masking strip. The securing strip has a pressure sensitive adhesive disposed at least next to the apertures, whereby the combination of the masking strip and the securing strip form a unitary structure and whereby the apertures only present adhesive to the front side of the masking strip. The structure is thereby adapted to receive and releasably secure an envelope package at each aperture.

14 Claims, 1 Drawing Sheet

APPARATUS FOR SECURING, DISPLAYING AND DISPENSING OF ENVELOPE PACKAGE GOODS

The invention relates to an apparatus for securing, displaying and dispensing a plurality of envelope packaged goods, and more particularly to such an apparatus which can accommodate a plurality of such packaged goods and be handled as a unitary structure for transportation, display and dispensing purposes.

BACKGROUND OF THE INVENTION

Envelope packaged goods have long since been standard items of commerce. While the goods packaged in envelopes vary considerably, traditionally, snack foods have been so packaged, and especially single serving snack foods. For example, single servings snacks such as potato chips, popcorn, corn chips, plantatin chips, fried pork rinds, and the like, are packaged in single serving envelopes, since it is intended that those single serving envelopes be displayed and dispensed at or near the place of consumption. For example, snack foods of this nature are displayed and dispensed in taverns, snack shops, convenience stores, and the like.

Since the average single serving envelope is relatively small, i.e. configured to hold about an ounce of the snack food, and since, ordinarily, a number of the envelopes are displayed at the point of purchase at any one time, the art has experienced a continued difficulty in providing apparatus for displaying and dispensing such envelop packages. In the earliest of displays, the packages were simply placed in a convenient-sized box or container but such displays never provide satisfactory since the box or container occupied considerable display space even when the box or container had only one or several packages remaining therein. Further, such display required a considerable amount of flat counter space. In view thereof, the art adopted a vertical display of such packages, which minimizes the counter space required for such display. One of the earliest vertical displays consisted of a rack with spring clips thereon. In this apparatus, each individual package was manually inserted into a spring clip for suspension and display purposes. While this approach minimizes the counter space required for display and dispensing, it entails considerable labor, since as packages are dispensed they must be manually replaced on the display. Since the ordinary profit margin in packaged snack foods is not very great, the amount of labor involved in such replenishing of the supply on the spring clip display caused considerable economic disadvantage.

One of the earliest efforts to avoid the labor involved in replenishing a spring clip type display was that of adhering the packages to a card of a size to contain a plurality of the packages. That card could be vertically disposed, e.g., on a counter, and when the supply of the packages was exhausted from that card, a like card with packages thereon could simply be substituted in its place. This considerably reduced the labor required for displaying and dispensing the packages. However, that early effort did not meet with success, since the card itself, even when nearly empty, still occupied considerable counter space and in addition was relatively unsightly when most of the packages had been removed therefrom. In addition, the adhesive used to adhere the packages to the card also adhered to the packages themselves. When the customer removed the package from the card and opened the package, the customer's fingers could easily contact the adhesive, and the adhesive on the customer's fingers made consumption of the snack food unappetizing. U.S. Pat. No. 2,361,141, is notable example of this approach to displaying and dispensing such packages. As pointed out in that 1944 patent, the adhesive being used was a gum adhesive or non-drying rubber solution adhesive.

In view of the problems associated with the packages being adhered to a card, as noted above, the art, largely, retained the spring clip display rack, even with the labor disadvantage associated therewith, until recently. For some display and dispensing purposes, suitable for some businesses, a peg board arrangement has been adopted. The peg board arrangement provides a plurality of laterally extending hangers and apertures are placed in the top of the package (above the sealing line thereof) so that the hangers may be passed through the appertures and support a plurality of packages thereon. While this approach is more economical from a labor point of view than the spring clip displays, it, nonetheless, still requires that each package be individually placed on the hangers. In addition, the peg board takes up considerable counter space (or wall space if so displayed) and suffers from yet a further disadvantage.

In this latter regard, since a single hanger may contained 5 to 10 packages, the customer removes the outermost package and when that hanger is replenished, all of the remaining packages must be removed and new packages placed behind the older packages in order to rotate the packages and avoid the contents of the packages from becoming stale. Thus, much of the labor saving achieved by the peg board and hanger arrangement, as opposed to the clip display arrangement, is lost in this necessary stock rotation.

In view of the above, another approach has been adopted in the art. This approach is similar to the approach of the display and dispensing card described in U.S. Pat. No. 2,361,141, discussed above, except that instead of an adhesive, the packages are stapled to the card. This avoids the problem of the adhesive, as discussed above, but this approach also encounters further difficulty. When a package is removed, the package must be torn from the staple. This not only requires more than desired effort on the part of the customer, but additionally leaves a ragged and torn edge on the package. That ragged and torn edge is capable of cutting the fingers of a customer but even more importantly, if the customer subsequently decides not to purchase that package, it is impossible to replace that package on the card and the torn edges of the package discourages other customers from purchasing that package. Thus, the salability of such a removed package is considerably reduced. This approach also has the difficulty that the card, like the card with the adhesive of U.S. Pat. No. 2,361,141 becomes unsightly after a number of the packages have been removed therefrom and, also, the card even with a small number of packages thereon still occupies considerable counter space. Additionally, the packages must be carefully aligned and stapled to the card, since if a staple passes through the package below the sealed line of the package the package is no longer "sealed" and will quickly deteriorate, in the case of a packaged food.

As can be appreciated from the foregoing, the art has not solved the problem of displaying and dispensing envelope packaged goods. It would therefore be of considerable advantage in the art to provide a display and dispensing apparatus where a plurality of the packages can be transported and displayed as a unit, which avoids individually handling and displaying each package as in a peg board or spring clip display, but where at the same time the packages may be dispensed without objectionable adhesive on the packages, as in the arrangement discussed above in conjunction with U.S. Pat. No. 2,351,141, or without the jagged and torn edges of the package dispensed from a staple board.

BRIEF DESCRIPTION OF THE INVENTION

The invention is based on several primary discoveries and several subsidiary discoveries. As a first primary discovery, it has been found that certain adhesives are capable of securing and suspending, on a suitable support, envelope packaged goods, while at the same time when the packages are removed from that support, the adhesive has the unexpected property of not adhering to the package. Thus,one of the major problems associated with the arrangement of U.S. Pat. No. 2,361,141, can be avoided by use of these certain adhesives.

As a subsidiary discovery in the foregoing regard, it was found that an adhesive to function in the foregoing manner must be an adhesive known in the art as a "pressure sensitive" adhesive. These adhesives function to adhere an object thereto by tackifying under pressure but the object tackified to the pressure sensitive adhesive can be released from the adhesive with a stripping motion which, in a sense, "unzips" the object from the tackified adhesive.

A second subsidiary discovery in this regard is that with such pressure sensitive adhesives, once a package has been removed, e.g., by a customer, if that customer decides not to purchase the package that package can be easily replaced on the display by applying moderate pressure to the package in juxaposition to the adhesive. Such reapplication leaves both the display and the package is essentially its original condition, and thus avoids the problem associated with packages stapled to a card, as noted above.

As a second primary discovery, it was found that a unitary structure could be provided in the form of a strip with apertures therein presenting the pressure sensitive adhesive and that the packages could be adhered to the respective apertures for displaying the packages in an ordered manner.

As a subsidiary discovery in this regard, it was found that the amount of pressure sensitive adhesive necessary to secure a package for purpose of transportation and the like, is relatively small and therefore the strip itself can be relatively small. Thus, the space required for displaying the packages with the present apparatus is essentially no more than the space required for the packages themselves and this avoids the problem of unused and unsightly empty spaces on a display device, such as associated with the spring clip display arrangement.

As a subsidiary discovery in this regard, it was found that such a unitary strip structure could easily be vertically displayed by providing a portion of the unitary structure to be received by a hanger or bar. That portion may be a folded-over end portion or a re-inforced portion for piercing by a hanger or a looped end portion disposed around a bar.

As a third major discovery, it was found that the appertures, with a pressure sensitive adhesive being presented therethrough, can be configured to present sufficient adhesive to more than adequately secure the packages for handling, transportation and the like, while at the same time allowing for the packages to be easily removed for dispensing purposes. This is, in part, by reason of the use of a pressure sensitive adhesive.

Thus, briefly stated, the present invention provides an apparatus for securing, displaying and dispensing a plurality of envelope packaged goods. The apparatus comprises an elongated masking strip having a front side and a back side and having a plurality of spaced-apart apertures therein. An elongated securing strip, having a front side and a back side and dimension which are not greater than the dimensions of the masking strip, is attached by its front side to the back side of the masking strip. The securing strip has a pressure sensitive adhesive disposed only on the front side thereof and at least at the portions thereof next to the apertures. Thus, this arrangement provides a combination of the masking strip and the securing strip in the form of a unitary structure which is free of adhesive on the back side of the securing strip and on the front side of the masking strip, except at the apertures of the masking strip. As a result thereof the appertures, only, present adhesive to the front side of the masking strip and thereby are adapted to receive and releasably secure an envelope package.

In order to provide for the handing of the strip with the packages thereon, an end portion is provided at at least one end of the unitary structure such that an adhesive free portion is provided and adapted to receive a supporting hanger for the unitary structure.

Preferably, the end most apperture is contacted with the adhesive of the next to the end most aperture, whereby a doubled aperture is provided which is free of adhesive on the securing strip and the masking strip. Alternatively, the end portion may be re-inforced with a paper or film.

Thus, the folded-over end portion or re-inforced portion is adapted to receive a supporting hanger for the unitary structure by way of the hanger piercing and passing through the doubled or re-inforced aperture.

The aperture is of a size and configuration to present sufficient adhesive to the front side of the masking strip through a single apperture that a portion of an envelope package may be releasably secured thereto.

The adhesive is an adhesive which will tackify to and releasably secure an envelope made of a polyolefin, cellophane, polystyrene, and wax paper (conventional packaging materials) but will not permanently adhere thereto. With this arrangement an envelope package may be removed from its securing disposition at an aperture without the removed package having any tactilely detectable adhesive thereon.

IN THE DRAWINGS

DETAILED DESCRIPTION OF THE INVENTION

Figure 1:
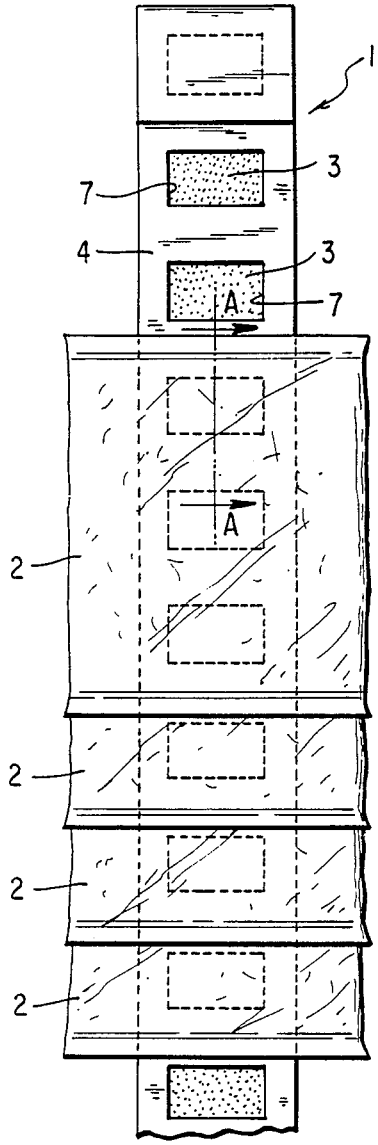
FIG. 1 is a front view of the present apparatus, with a plurality of packages being displayed thereon.

FIG. 1 shows a front view of the apparatus, generally 1, having secured thereto a plurality of packages 2. The packages are nested on the apparatus (see FIg.4) and each package is secured to an area of adhesive 3. In FIG. 1, the packages 2 obscure the adhesive to which they are attached, but FIG. 1 shows two areas of adhesive 3 without packages secured thereto. For explanatory purposes, the apparatus is comprised of an elongated masking strip 4 having a front side 5 and a back side 6 (see FIG. 2). The masking strip 4 has spaced-apart aperture 7. An elongated securing strip 8 has a front side 9 and a back side 10. The securing strip 8 is dimensioned such that its dimensions are no greater than the dimensions of masking strip so that the masking strip 4 covers the entire front side 9 of securing strip 8 except at aperture 7. Thus, any adhesive on securing strip 8 will be presented to the front side 5 of masking strip 4 only at aperture 7.

The securing strip has a pressure sensitive adhesive 20 disposed on front side 9 thereof. The adhesive is disposed at least at the portions thereof next to aperture 7, but more usually the adhesive will be disposed over the entire front face 9 of securing strip 8. In any event, there must be sufficient adhesive 20 to present adhesive to apertures 7 and to attach securing strip 8 at its front side 9 to the back side 6 of masking strip 4. It is important that there is no adhesive on back side 10 of securing strip 8, since otherwise that adhesive would interfere with the handling and transportation of the apparatus, since different strips of the apparatus could adhere to each other.

Figure 2:
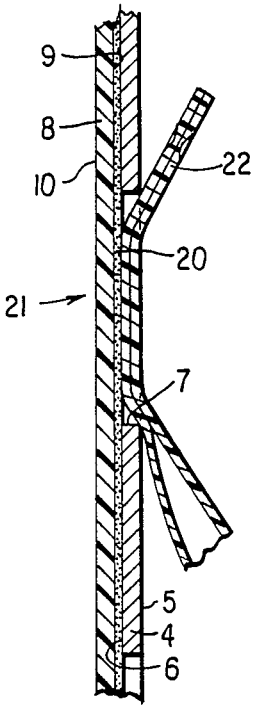
FIG. 2 is a highly enlarged diagrammatic illustration of a sectioned view along lines A—A in FIG. 1.

It can thus be seen from FIGS. 1 and 2 that the combination of the masking strip and the securing strip form a unitary structure, generally 21 (see FIG. 2) which is free of adhesive on the back side 10 of securing strip 8 and on the front side 5 of masking strip 4, except at the apertures 7 of the masking strip 4. Accordingly, only the apertures present adhesive to the front side 5 of the masking strip and these apertures are thereby adapted to receive and releasably secure an envelope package.

Figure 4:
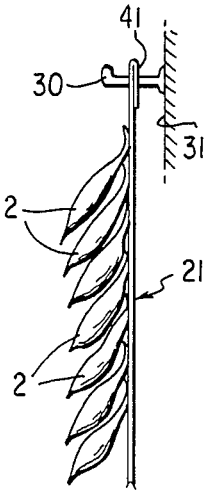
FIG. 4 is a diagrammatic illustration of the present apparatus with packages secured thereto and hung for display purposes.

FIG. 2 shows a portion of the film 22 of an envelope package where that film is pressed against adhesive 20 and adhered thereto by way of the function of the pressure sensitive adhesive. Thus, the packages are securely attached to the unitary structure 21 and are nested, one about the other, as shown in FIGS. 1 and 4.

That unitary structure 21 with packages 2 adhered thereto is capable of so adhering the packages to the unitary structure that the combination of the packages and unitary structure can be handled, transported and otherwise manipulated without the packages being detached from the unitary structure. This is because the pressure sensitive adhesive used in the present unitary structure so securely attaches the packages that even rough handling of the structure with the packages thereon will not displace the packages from the structure, and even though the packages may be easily, manually, removed therefrom, in the manner described below.

Figure 3:
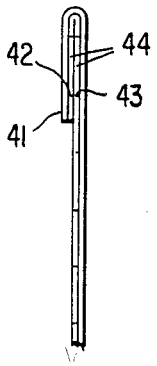
FIG. 3 is a side view of a portion of FIG. 1, showing a doubled apperture for hanging purposes.

The unitary structure with the packages thereon would be manufactured by the manufacturer of the snack food. A number of these unitary structures with the packages would be shipped to the distributor and hence to the retailer. In order to display the packages, the retailer hangs the unitary structures with the packages thereon on convenient hangers. This is shown in FIG. 4 where a hanger 30 is disposed in some convenient support, e.g., wall 31 or the like, and the unitary structure 21 is then hung on that hanger. To this end, the end portion may simply be re-inforced, e.g., with heavy paper, plastic tape or an additional piece of the securing tape, whereby an adhesive free portion is provided. However, it is preferred that in producing the unitary structure, a folded-over end portion 41 (see FIG. 3) is provided at one end (or both ends) of the unitary structure. By folding over the end portion of the unitary structure, the adhesive presented through the end most aperture 42 is contacted with the adhesive presented through the next to the end most aperture 43 whereby a doubled aperture 44 in the folded-over end portion is provided. It will be noted that since the folded-over portion 41 abuts adhesive to adhesive in the doubled aperture 44, the folded-over portion is free of adhesive on the back side of securing strip 8 and the front side of masking strip 4. Therefore, the folded-over portion provides an adhesive free portion which is adapted to receive a support hanger 30 (see FIG. 4), without any adhesive interfering with the hanging of unitary structure 21 on hanger 30. Thus, the unitary structure 21 is easily hung simply by piercing the doubled aperture 44 (piercing through the two securing strips 8 forming the doubled aperture 44) or by providing an aperture in doubled apperture 44 for receiving the hanger.

The apertures 7 are of such a size and configuration to present sufficient adhesive 20 to the front side 5 of a masking strip 4 that through a single aperture 7 (see FIG. 2) a portion of the envelope package (film 22) may be releasably secured to adhesive 20. The size of the aperture will depend upon the size of the package, the specific pressure sensitive adhesive being used, and the package material itself. However, an appropriate particular pressure sensitive adhesive and any particular package material by simple experimentation. Nevertheless, e.g., for an ordinary single serving snack food, e.g., approximately 1 oz., the aperture can have an area as little as 0.25 sq. inch and still provide more than adequate security of the attached package. On the other hand, the aperture could be as large as desired, since a function of the pressure sensitive adhesive is to allow removal of the package by a stripping motion, as explained below, and therefore, larger aperture will provide more than required security of the package while still allowing the package to be easily removed by that stripping motion. Nevertheless, generally speaking, there is no need for the aperture to be more than 1 sq. inch, especially no more than 1.5 sq. inches. As can be appreciated, and as shown in FIG. 1, the width of the unitary structure can therefore be small compared to the width of the packages contained thereon.

It is most important to the present invention that the adhesive used is a pressure sensitive adhesive. Pressure sensitive adhesives do not function by "gluing" the package to the unitary structure, but instead function so as to tackify when pressure is exerted thereon. Thus, when the package is pressed against the adhesive, the adhesive tackifies and secures the package to the unitary structure by such tackification. This is an exceptionally strong bond between the pressure sensitive adhesive and the package so that the package on the unitary structure may be even roughly handled without being displaced therefrom. However, as another important function of a pressure sensitive adhesive, even with such a strong bond, the package can be removed from the adhesive by a stripping motion, as explained more fully below, and with only moderate effort.

However, the adherence of the package to the adhesive will vary somewhat with the adhesive and the material of the package. However, since most packages of the present nature are made either of a polyolefin, e.g., polyethylene and polypropylene, or cellophane or polystyrene or waxed paper, it is only necessary to ensure that the adhesive is one which will tackify and releasably secure a package made of those materials, but at the same time will not permanently adhere to those materials. This, again, can easily be determined by limited experimentation. This latter feature is important, since when the package is removed from its securing disposition at an aperture that removal should be such that the removed package will have no tactilely detectable adhesive adhered thereto. This avoids the problem of the adhesive being encountered by the customer when attempting to open and consume the contents of the package. As explained above, it is important for the consumer not to encounter any adhesive when either removing the package or in handling the unitary structure on which the packages are secured. It is for this latter reason that it is important that securing strip 8 be of no greater dimensions than the dimensions of the masking strip 5 so that any adhesive on the securing strip is covered by the masking strip, other than at the apertures. Likewise, it is for this reason that it is important that folded-over portion 41 be free of adhesive, in the manner explained above. This is particularly important in regard to the width of the securing strip, since if the width of the securing strip is greater than the width of the masking strip, some adventuresome amount of adhesive could contact the customer when removing a package. Therefore, the width dimensions of the securing strip should be the same or slightly less than the width dimensions of the masking strip, and this is particularly important when the adhesive is disposed over the entire front side of the securing strip.

As can be seen from FIG. 1, for the reasons explained above, the width of the unitary structure can be less, even considerably less than the width of the packages secured thereto. Thus, the combination of the unitary structure and the packages takes up almost no more space than would the packages themselves. This considerably conserves counter space or wall space in displaying packages, as opposed to the space required in prior art approaches, as explained above.

In removing a package from the unitary structure, the customer need not even touch the unitary structure. A package is removed by a stripping motion. In this regard, if a piece of pressure sensitive tape is pressed against a flat surface, e.g., the top of a desk, that adherence is exceptionally strong and any attempt to remove that tape by a vertical pull would meet with singular unsuccessful results. However, if an end of that tape is dislodged from that desk surface, the tape may be removed by gentling pulling along the length of the tape. This is referred to in the art as a stripping motion, and pressure sensitive tapes may be tested for their stripping strengths. This is a unique function of pressure sensitive adhesives, and the function allows the present packages to be easily removed from the unitary structure, even though the packages are strongly attached thereto. This strong attachment allows even rough handling without dislodgement, since rough handling will not normally result in a stripping motion. Therefore, by choosing the particular pressure sensitive adhesive, and the size of the apperture, the packages are sufficiently secured to the unitary structure such that during transportation and handling thereof they are sufficiently secured to the unitary structure so as not to be dislodged, but that adherence is insufficient to require more than easily achieved manual release of the packages from the unitary structure, i.e. a manual release achieved by stripping pull of the package.

As shown in FIG. 4, the packages are nested one above the other. Thus, the unitary structure is dimensioned to receive a plurality of nested packages, e.g., single serving snack food envelop packages. To remove a package, the customer need only grasp, e.g., one of the corners of the package, and pull from that corner toward the other corner, which will produce the stripping motion described above. Alternatively, the bottom or top of the package may be grasped and pulled upwardly, which again will produce the stripping motion required.

More conveniently, the apertures are arranged in a single row on the unitary structure, as shown in FIG. 1, so that the packages with the snack food therein are nested one above the other (also see FIG. 4). Thus, the customer will normally grasp the topmost package at a corner, bottom or top and remove that package simply by the stripping motion described.

When the apertures are arranged in a single row, one above the other, the doubled aperture 44 of folded-over section 41 will be at the topmost portion of the unitary structure, i.e. the topmost aperture and the nested snack food packages will hang vertically downwardly therefrom when the unitary structure is hung from a hanger, e.g., hanger 30 passing through the doubled aperture. With this arrangement, once all of the packages have been removed from the unitary structure, to replenish the supply, it is only necessary to take an additional unitary structure with the plurality of packages thereon and pierce the doubled aperture with hanger 30. In one very quick easily accomplished operation, a number of packages are replenished to supply sold packages from that hanger. In addition, should a customer remove a package and then decide not to purchase the package, that package is essentially intact, i.e. in the same condition as before removal, and may be replaced on the unitary structure at a vacant aperture simply by pressing the package thereagainst. This avoids the problem noted above in connection with packages being stapled to a card for display purposes.

The materials of construction of the unitary structure are not critical, with the exception that the adhesive must be a pressure sensitive adhesive. The securing strip and the masking strip may be made of the same or different materials, and those materials may range almost as desired, e.g., glassine paper, wax paper, or even just heavy smooth paper. Alternatively the strips may be made of plastic material,e.g., polyolefin films (polyethylene or polypropylene), polyvinylidene chloride films, vinyl films, etc. However, it is preferred that the securing strip be made of a plastic film, since the securing strip, more conveniently, will be entirely coated with the pressure sensitive adhesive, and plastic films are more ordinarily so coated. Indeed, a preferred form of the invention is where the securing film is a commercially available tape film such as the pressure sensitive tape films available from the 3 M Company. These tape films are plastic films with a pressure sensitive adhesive coating thereon, and the plastics may be of polyethylene, polypropylene, Mylar, and the like. The particular plastic film is not critical.

In a very convenient form of the invention, the masking strip is a heavy calendared paper with the width thereof being somewhere about 2 inches, the aperture being about $1\frac{1}{4}$in.$\times\frac{3}{4}$in., with the longest side of the aperture being in the width direction of the masking strip. The apertures are spaced apart about 1½ inches on center. The securing strip is a 3 M Brand HIGHLAN Tape which is about 1⅞ inches in width, thus providing that the securing strip has dimensions no greater than the dimensions of the masking strip. The masking strip may have printing thereon, such as a "brand" name, price, slogan, etc. or an ornamental design, e.g., between appertures.

The unitary structure is thus provided simply by pressing a length appertured masking strip to a length of the tape film with the pressure sensitive adhesive thereon. The envelope packages are then applied to the unitary structure simply by pressing the top portion of the packages against the pressure sensitive tape presented at each apperture.

As can be appreciated from the above, the invention may take many forms of configuration. Thus, the appertures may be arranged in patterns other than a row arrangement, i.e. the one-above-the-other pattern shown in FIG. 1. For example, a plurality of rows may be used to secure a plurality of rows of packages thereto and each row may contain different envelope packaged goods, e.g., one row of potato chips, one row of pretzels, one row of plantain chips, etc. Alternately, there may be rows of different headaches or stomach remedies. The appertures may be arranged in an ornamental design to provide, for example, a display of packaged goods in the shape of a heart or play card design. Or the arrangement of apertures may spell a name or slogan or place. Additionally, if desired, more than one aperture may be used to secure a simple package or in some cases a single aperture may secure more than one package.

As can also be appreciated, the hanging of the structure may also take different forms. Thus,in addition to the re-inforced apperture and the doubled aperture being pierced by a hanger for depth display of the structures, as discussed above, the hanger for the structure may be in the form of a laterally disposed bar or the like for a lateral display of the packages. In this embodiment, the end most aperture is stripped from the next to the end most apperture of the doubled apperture, i.e. these two appertures are parted, and the end most aperture is looped over the top and around the back of a laterally disposed bar or the like and then re-adhered to the next to the end most apperture. This forms a loop around the laterally disposed bar and hangs the structure from the laterally disposed bar or the like. Alternatively, instead of parting the doubled aperture, as described above, a strippable member, e.g., a paper or film may be disposed over the end most aperture and the next to the end most aperture and when the structure is to be hung from the laterally disposed bar or the like, the stripable member is removed from these two apertures and the end most apperture is looped around the laterally disposed bar and adhered to the next to next to the end most aperture, in the manner described above.

Thus, from the foregoing disclosure, it can be seen that many modifications will be quite apparent to those of ordinary skill in the art. It is intended that these modifications be included within the scope and spirit of the annexed claims.

What is claimed is:

1. An apparatus for securing, displaying and dispensing a plurality of envelope packaged goods, comprising:

(1) an elongated masking strip having a front side and a back side and having a plurality of spaced apart apertures therein;

(2) an elongated securing strip having a front side and a back side and width dimensions which are no greater than the dimensions of the masking strip and being attached by its front side to the back side of the masking strip, said securing strip having a pressure sensitive adhesive disposed only on the front side thereof and at least at the portions thereof next to said apertures, whereby the combination of the masking strip and the securing strip form a unitary structure which is free of adhesive on the back side of the securing strip and on the front side of the masking strip except at the apertures of the masking strip, whereby the said apertures only present adhesive to the front side of the masking strip and are thereby adapted to receive and releasably secure envelope packages;

(3) an end portion at least at one end of the said unitary structure whereby an adhesive free portion is provided and adapted to receive a supporting hanger for the unitary structure;

(4) said apertures being of a size and configuration to present sufficient adhesive to the front side of the masking strip through a single aperture that a portion of an envelope package may be releasably secured thereto; and (5) said adhesive being an adhesive which will tackify to and releasably secure an envelope made of a polyolefin, cellophane, polystyrene, and waxed paper, but will not permanently adhere thereto, sot hat an envelope package may be removed from its securing disposition at any aperture without the removed package having any tactilely detectable adhesive thereon.

2. The apparatus of claim 1, wherein the width dimensions of the securing strip are the same or slightly less than the width dimensions of the masking strip.

3. The apparatus of claim 2, wherein the adhesive is disposed over the entire front side of the securing strip.

4. The apparatus of claim 3, wherein the width of the said unitary structure is less than the width of the envelope packages secured thereto.

5. The apparatus of claim 1, wherein the masking strip and the securing strip are made of plastic materials.

6. The apparatus of claim 1, wherein the apertures are of a size that the area of adhesive presented through the apertures is sufficient to secure the envelope packages during transportation and handling thereof and insufficient to require more than an easily achieved manual release thereof.

7. The apparatus of claim 6, wherein the manual release is achieved by a stripping pull on the envelope package.

8. The apparatus of claim 1, wherein the unitary structure is dimensioned to receive a plurality of nested, single serving snack food envelope packages.

9. The apparatus of claim 8, wherein the apertures are arranged in a single row on the unitary structure so that the said snack food envelope packages are nested one above the other.

10. The apparatus of claim 9, wherein the said nested snack food envelope packages will hang vertically downwardly when the unitary structure is hung from a hanger.

11. The apparatus of claim 1, wherein a folded-over end portion at least at one end of the said unitary structures is provided such that the adhesive presented through the end most aperture is contacted with the adhesive presented through a next to the end most aperture whereby a doubled apperture in the folded-over end portion is provided and the folded-over portion is free of adhesive on the back side of the securing strip and on the front side of the masking strip and whereby the folded-over end portion thereby provides an adhesive free portion adapted to receive a support hanger for the unitary structure by way of a hanger piercing and passing through the doubled apperture.

12. The apparatus of claim 11, wherein the said doubled aperture is strippable such the end most aperture can be parted from the next to the end most aperture, whereby the end most apperture is loopable around a bar and re-adhereable to the next to the end most apperture for hanging the said structure on a laterally disposed bar.

13. The apparatus of claim 1, wherein an end most aperture and a next to the end most apperture have disposed thereon a strippable member, whereby the strippable member may be removed therefrom and the end most apperture is loopable around a laterally disposed bar and adhereable to the next to the end most apperture for hanging the structure from the said laterally disposed bar.

14. The structure of claim 13, wherein the strippable member is a paper or film.

* * * * *